US012624922B2

(12) United States Patent
Sun et al.

(10) Patent No.: US 12,624,922 B2
(45) Date of Patent: May 12, 2026

(54) LED EMERGENT LIGHT ADJUSTING MECHANISM AND INNER-RED-DOT AIMING DEVICE THEREFOR

(71) Applicant: HUANIC CORPORATION, Shaanxi (CN)

(72) Inventors: Jianhua Sun, Shaanxi (CN); Meng Zhao, Shaanxi (CN); Dong Wang, Shaanxi (CN); Qiong Jiang, Shaanxi (CN)

(73) Assignee: HUANIC CORPORATION, Shaanxi (CN)

( * ) Notice: Subject to any disclaimer, the term of this patent is extended or adjusted under 35 U.S.C. 154(b) by 367 days.

(21) Appl. No.: 18/026,859

(22) PCT Filed: Oct. 14, 2020

(86) PCT No.: PCT/CN2020/120748

§ 371 (c)(1),
(2) Date: May 15, 2023

(87) PCT Pub. No.: WO2022/056973

PCT Pub. Date: Mar. 24, 2022

(65) Prior Publication Data

US 2023/0358506 A1 Nov. 9, 2023

(30) Foreign Application Priority Data

Sep. 17, 2020 (CN) ..... 202010977060.4

(51) Int. Cl.
*F41G 1/30* (2006.01)
*F41G 1/26* (2006.01)
*F41G 1/34* (2006.01)

(52) U.S. Cl.
CPC ..... *F41G 1/345* (2013.01); *F41G 1/26* (2013.01); *F41G 1/30* (2013.01)

(58) Field of Classification Search
CPC ..... F41G 1/26; F41G 1/30
See application file for complete search history.

(56) References Cited

U.S. PATENT DOCUMENTS 6,327,806 B1 * 12/2001 Paige ..... F41G 1/30 42/130
7,526,890 B1 * 5/2009 Keng ..... F41G 1/26 42/144

(Continued)

FOREIGN PATENT DOCUMENTS

CN 205718670 U 11/2016
CN 206019473 U 3/2017

(Continued)

OTHER PUBLICATIONS

Machine Translation of Sun. CN 109931816 A. Jun. 25, 2019. (Year: 2019).*

(Continued)

*Primary Examiner* — Gabriel J. Klein
(74) *Attorney, Agent, or Firm* — CANTOR COLBURN LLP

(57) ABSTRACT

An LED emergent light adjusting mechanism and an inner-red-dot aiming device therefor, wherein the LED emergent light adjusting mechanism comprises a vertical adjusting assembly and a horizontal adjusting assembly; the vertical adjusting assembly comprises an up-and-down adjusting sliding block, a vertical adjustment screw and two vertical adjustment spring sets arranged on two sides of the vertical adjustment screw; a nut member and a spring guiding and limiting column set are fixed at the bottom of a rear end of the up-and-down adjusting sliding block; the horizontal adjusting assembly comprises a left-and-right sliding block, a return spring, a vertical spring ejector pin assembly, a horizontal spring ejector pin assembly, a horizontal adjusting screw coupled with the other end of the left-and-right (Continued)

sliding block by means of a square nut, and an LED chip assembly arranged on a front end surface of the left-and-right sliding block.

9 Claims, 9 Drawing Sheets

(56) References Cited

U.S. PATENT DOCUMENTS

| | | | | |
|---|---|---|---|---|
| 8,215,050 | B2 * | 7/2012 | Elpedes | F41G 1/14 42/131 |
| 11,054,629 | B1 * | 7/2021 | Sheydayi | G02B 23/105 |
| 12,235,073 | B2 * | 2/2025 | Sun | F41G 1/26 |
| 12,253,336 | B1 * | 3/2025 | Li | F41G 3/08 |
| 2012/0151816 | A1 * | 6/2012 | Kleck | F41G 1/30 42/111 |
| 2014/0096431 | A1 * | 4/2014 | Tang | F41G 1/30 42/111 |
| 2014/0190062 | A1 | 7/2014 | Turner | |
| 2015/0198415 | A1 * | 7/2015 | Campean | F41G 1/30 42/137 |
| 2018/0045486 | A1 | 2/2018 | Jeung et al. | |
| 2020/0240748 | A1 * | 7/2020 | Connolly | F41G 1/387 |
| 2021/0262759 | A1 * | 8/2021 | Sun | F41G 1/30 |
| 2022/0163289 | A1 * | 5/2022 | Sun | F21V 21/18 |
| 2023/0096514 | A1 * | 3/2023 | Nichols | F41G 1/345 42/132 |
| 2023/0176387 | A1 * | 6/2023 | Sabaldan Elpedes | H05B 47/11 362/23.19 |
| 2023/0358506 | A1 * | 11/2023 | Sun | F41G 1/30 |
| 2023/0366656 | A1 * | 11/2023 | Sun | F41G 1/28 |
| 2025/0035913 | A1 * | 1/2025 | Sun | F41G 1/32 |

FOREIGN PATENT DOCUMENTS

| | | | | | |
|---|---|---|---|---|---|
| CN | 206019475 | U | | 3/2017 | |
| CN | 206878117 | U | | 1/2018 | |
| CN | 207247992 | U | | 4/2018 | |
| CN | 109405645 | A | | 3/2019 | |
| CN | 109931816 | A | | 6/2019 | |
| CN | 211480500 | U | | 9/2020 | |
| JP | 2007187397 | A | | 7/2007 | |
| JP | 2017503145 | A | | 1/2017 | |
| KR | 20120026645 | A | | 3/2012 | |
| KR | 20160107703 | A | * | 9/2016 | F41G 1/30 |
| KR | 20190076084 | A | * | 7/2019 | F41G 1/545 |

OTHER PUBLICATIONS

Japanese Office Action for Japanese Patent Application No. 2023-517695 dated Feb. 6, 2024.

Korean Patent No. 10-2023-7012736 1st Office Action with English Translation, Report dated Apr. 13, 2025.

International Search Report for corresponding application PCT/CN2020/120748 filed Oct. 14, 2020; Mail date Jun. 16, 2021.

* cited by examiner

LED EMERGENT LIGHT ADJUSTING MECHANISM AND INNER-RED-DOT AIMING DEVICE THEREFOR

CROSS-REFERENCE TO RELATED APPLICATIONS

The present application is a national phase application under 35 U.S.C. 371 of International Application No. PCT/CN2020/120748 filed on Oct. 14, 2020, the entire contents of which are incorporated herein by reference.

TECHNICAL FIELD

The present disclosure relates to the technical field of aiming devices for guns, and in particular, relates to an LED emergent light adjusting mechanism and an inner-red-dot aiming device.

BACKGROUND

In order to improve the shooting accuracy and adapt to different shooting occasions or targets, it is necessary to adjust the emission angle of the LED light source of the inner-red-dot aiming device. Generally, the adjusting screw and the return spring are configured to be matched with each other to complete the adjustment of the pitch angle or the left-and-right angle of the emission angle of the LED light source, and especially the up-and-down adjusting mechanism operates independently, inevitably causing the mutual influence, resulting in the adjustment of the pitch angle to be affected by the adjustment of the left-and-right angle, and thus leading to the low precision and instability and reducing the good user experience. For example, referring to Invention Patent No. 2016209805049, titled "LIGHT SOURCE ADJUSTING MECHANISM FOR INNER-RED-DOT AIMING DEVICE", each of the adjustment of the pitch angle and the adjustment of the left-and-right angle depends on an independently operating mechanism.

In addition, the existing inner-red-dot aiming devices mainly rely on rechargeable batteries for power supply, or combined with solar cells for supplementary power supply. However, they can only choose battery power supply or solar cell power supply according to the ambient light, and cannot realize the separate power supply to the combined light sources. Referring to the Invention Patent No. 201620535771.5, titled "SOLAR INNER-RED-DOT AIMING DEVICE", it only selects the power supply, and cannot realize the selective power supply to the light source so as to meet the sufficient illumination required for shooting.

SUMMARY

An object of the present disclosure is to increase the stability of the adjustment of the LED light source, avoid the mutual influence of the adjustment of the pitch angle or the adjustment of the left-and-right angle, thereby improving the shooting accuracy; and another object of the present disclosure is to realize the selective power supply control of the LED light source and the supplement to electric energy of the rechargeable battery according to the self-adaption for the intensity of the ambient light, so as to make reasonable use of the power supply and the LED light source for shooting that matches with the ambient light.

In order to achieve the above objects, an LED emergent light adjusting mechanism includes a vertical adjusting assembly and a horizontal adjusting assembly, the vertical adjusting assembly comprises an up-and-down adjusting sliding block, a vertical adjustment screw, and two vertical adjustment spring sets which are respectively arranged on two sides of the vertical adjustment screw and are symmetrical with respect to the vertical adjustment screw;

a nut member fixed at a middle portion of a bottom side at a rear end of the up-and-down adjusting sliding block for threadedly connecting with a bolt of the vertical adjustment screw;

two guiding and limiting column sets symmetrically provided on two sides of the nut member for sleeving the vertical adjustment spring sets thereon, a base of the guiding and limiting column set being fixedly connected with the bottom side at the rear end of the up-and-down adjusting sliding block;

the horizontal adjusting assembly comprises a left-and-right sliding block, a return spring having one end sleeved on a limiting protrusion at one end portion of the left-and-right sliding block, two vertical spring ejector pin assemblies symmetrically arranged on a top surface of the left-and-right sliding block, two horizontal spring ejector pin assemblies symmetrically arranged at a rear end of the left-and-right sliding block, a horizontal adjustment screw coupled to the other end of the left-and-right sliding block through a square nut, and a LED chip assembly arranged on a front end surface of the left-and-right sliding block;

a mounting groove is provided on a front end surface of the up-and-down adjusting sliding block, the left-and-right sliding block is placed in the mounting groove, and the return spring is placed between the left-and-right sliding block and a baffle plate fixed at an end portion of the mounting groove; the square nut is placed outside the other end portion of the mounting groove.

Each of the vertical adjustment screw and the horizontal adjustment screw comprises a conical tip, a tip spring, a tip plug, and a fine-tuning gland provided with a plurality of ribs on an inner circumference surface;

the conical tip, the tip spring and the tip plug are sequentially arranged in a radial mounting hole of a cap nut of the horizontal adjusting screw or the vertical adjustment screw, and an outer diameter of a large head end of the conical tip is greater than an inner diameter of a top outlet of the mounting hole, so that a small head end of the conical tip extends out to abut against the ribs; the vertical spring ejector pin assembly is placed between the top surface of the left-and-right sliding block and a top wall of the mounting groove to eliminate a mounting gap in a vertical direction of the left-and-right sliding block.

the horizontal spring ejector pin assembly is placed between the rear end of the left-and-right sliding block and a side wall of the mounting groove to eliminate a mounting gap in a front-and-rear direction of the left-and-right sliding block.

The vertical spring ejector pin assembly or the horizontal spring ejector pin assembly is composed of a steel ball gland, a steel ball and a steel ball pressure spring, the steel ball is pressed on a through hole of the steel ball gland by the steel ball pressure spring, and a pore diameter of the through hole is smaller than an outer diameter of the steel ball, to prevent the vertical adjustment screw or the horizontal adjustment screw from being loosened due to vibration.

The steel ball gland is formed by integrally connecting a ring portion and a trumpet portion to form a conical hole penetrating through the steel ball gland;

the steel ball touches and is pressed on the ring portion.

The LED chip assembly comprises an LED light source composed of a central point light source and a discontinuous annular light source surrounding around the central point light source.

An angle between the ribs is 15°, and 24 ribs are evenly arranged along an inner side of the fine-tuning gland in a circumferential direction, so that the LED chip assembly moves between upward and downward or between leftward and rightward by a certain distance once the vertical adjustment screw or the horizontal adjusting screw rotates and slides over one of the ribs.

An inner-red-dot aiming device having a LED emergent light adjusting mechanism comprising a aiming device base, the LED emergent light adjusting mechanism is arranged in a mechanism mounting cavity at a rear end of the aiming device base; and a front end of the mechanism mounting cavity is provided with a window, and a rearwardly inclined protective glass is mounted in the window;

the LED chip assembly is placed between the protective glass and the left-and-right sliding block;

the horizontal adjustment screw is mounted in a counterbore at a side of the rear end of the aiming device base and is coupled to the square nut mounted in the mechanism mounting cavity;

the vertical adjustment screw is mounted in a counterbore at a top portion of the rear end of the aiming device base, and penetrates into the mechanism mounting cavity to be threadedly coupled to the nut member;

a top end of each of the two vertical adjustment spring sets abuts against inside of a top wall of the mechanism installation cavity.

The LED chip assembly comprises a circuit board, a left PD (photodiode) and a right PD symmetrically arranged on both sides of the LED light source; the circuit board is electrically connected with a battery arranged at the front end of the aiming device base and a solar battery arranged at the rear end of the mechanism mounting cavity, respectively;

the LED light source is composed of a central point light source and a discontinuous annular light source surrounding around the central point light source;

the left PD and the right PD are configured to collect an ambient light emitted into the protective glass, so that when a light intensity of the ambient light is greater than or equal to a given threshold, the central point light source and the discontinuous annular light source constituting the LED light source are powered simultaneously by the circuit board, while the battery is charged; and when the light intensity of the ambient light is less than the given threshold, only the central point light source is powered by the circuit board; and when the ambient light is not enough to drive the central point light source, the power is supplied by the battery.

A battery compartment and a battery holder assembly placed in the battery compartment are provided at the front end of the aiming device base, the battery holder assembly comprises a horizontal pressure sheet, a negative electrode elastic sheet, a positive electrode elastic sheet and a battery holder;

an inner end of the horizontal pressure sheet is centrally connected with atop portion of an outer surface of a fixing seat; each of left and right ends of the fixing seat is provided with a fixing seat screw hole;

a bottom surface of the fixing seat is provided with a negative electrode elastic sheet mounting groove;

the negative electrode elastic sheet comprises an elastic sheet body placed on a bottom surface of the horizontal pressure sheet, a clamping elastic sheet connected with an inner end of the elastic sheet body through a vertical segment and horizontally extending rearward and bending upward; and a limiting sheet connected with each of left and right sides of the vertical segment; wherein the limiting sheet is inclined from a connection with the vertical segment to a side away from the elastic sheet body in a direction of an outer end of the elastic sheet body;

the negative electrode elastic sheet mounting groove comprises a limiting beam at rear and fin limiting grooves extending outward from both sides of a front end of the limiting beam; the vertical segment and the clamping elastic sheet are clamped on the limiting beam, wherein the vertical segment abuts against a front side wall of the limiting beam, and the clamping elastic sheet abuts against a rear side wall of the limiting beam, so that the elastic sheet body is fastened to a bottom surface of the horizontal pressure sheet;

a limiting groove for assembling the limiting fin at a tail end of the positive electrode elastic sheet is provided on the bottom surface of the fixing seat;

the battery holder is composed of a block portion that are convenient to plug in and out and two supporting members symmetrically arranged at inner ends of the block portion;

a supporting member screw hole portion coaxial with the fixing seat screw hole is provided on a top surface of a tail end of the supporting member;

the fixing screw penetrates into the battery compartment from the other side of the aiming device base, and is sequentially connected with the fixing seat screw hole and a screw hole on the supporting member screw hole portion.

Two elastic abutting portions symmetrically distributed and placed between the fixing seat screw holes are provided at an inner end of the fixing seat;

the two elastic abutting portions extend opposite to each other to form an encircling state, and form an elliptical space with an assembling groove, so as to provide a retraction space sufficient for the elastic abutting portion when being abutted.

The present disclosure has advantages below: under the condition that the pitch angle and the left-and-right position adjusting mechanisms are assembled together, it is ensured that the pitch adjusting mechanism and the left-and-right adjusting mechanism move up or down synchronously when the pitch angle is adjusted, and the left-and-right adjustment cannot be affected; and on the other hand, influence on the pitch adjustment upon the left-and-right adjustment can be avoided, that is, the pitch adjustment (or the vertical adjustment) cannot be affected by the left-and-right adjustment, stability of the adjustment of the LED light source can be improved, the structure is compact and the volume is small, and the lighting combination of the LED light source with self-adaption for the ambient light can be realized, that is, it is possible to employ one light source for operation or simultaneously employ two light sources for operation, to meet the requirements of different ambient lights for the shooting brightness, reasonably utilize the electric energy of the rechargeable battery or solar cell, reduce the waste of electric energy and prolong the service life of the rechargeable battery.

The present disclosure will be described in detail below in combination with the accompanying drawings and embodiments.

LIST OF REFERENCE NUMBERS

1 Up-and-down Adjusting Sliding Block
2 Vertical Adjustment Screw
3 Vertical Adjustment Spring Set
4 Nut Member
5 Spring Guiding and Limiting Column Set
6 Left-and-right Sliding Block
7 Limiting Protrusion
8 Return Spring
9 Vertical Spring Ejector Pin Assembly
10 Horizontal Spring Ejector Pin Assembly
11 Square Nut
12 Horizontal Adjusting Screw
13 LED Chip Assembly
14 Mounting Groove
15 Conical Tip
16 Tip Spring
17 Tip Plug
18 Rib
19 Fine-tuning Gland
20 Cap Nut
21 Steel Ball Gland
22 Steel Ball
23 Steel Ball Pressure Spring
24 Ring Portion
25 Trumpet Portion
26 Conical Hole
27 Aiming Device Base
28 Mechanism Mounting Cavity
29 Chip Protective Glass
30 LED Light Source
31 Left PD (photodiode)
32 Right PD
33 Battery
34 Solar Cell
35 Battery Compartment
36 Horizontal Pressure Sheet
37 Negative Electrode Elastic Sheet
38 Positive Electrode Elastic Sheet
39 Battery Holder
40 Fixing Seat
41 Fixing Seat Screw Hole
42 Limiting Beam
43 Elastic sheet Body
44 Vertical Segment
45 Clamping Elastic Sheet
46 Limiting Sheet
47, 48 Fin Limiting Groove
49 Limiting Fin
50 Limiting Groove
51 Block Portion
52 Supporting Member
53 Supporting Member Screw Hole Portion
54 Screw Hole
55 Fixing Screw
56 Rechargeable Lithium Battery
57 Solar Protective Glass
58 O-ring
59 Abutting Portion
60 Elliptical Space
61 Blind Hole
62 Baffle Plate

DETAILED DESCRIPTION

Figure 1:
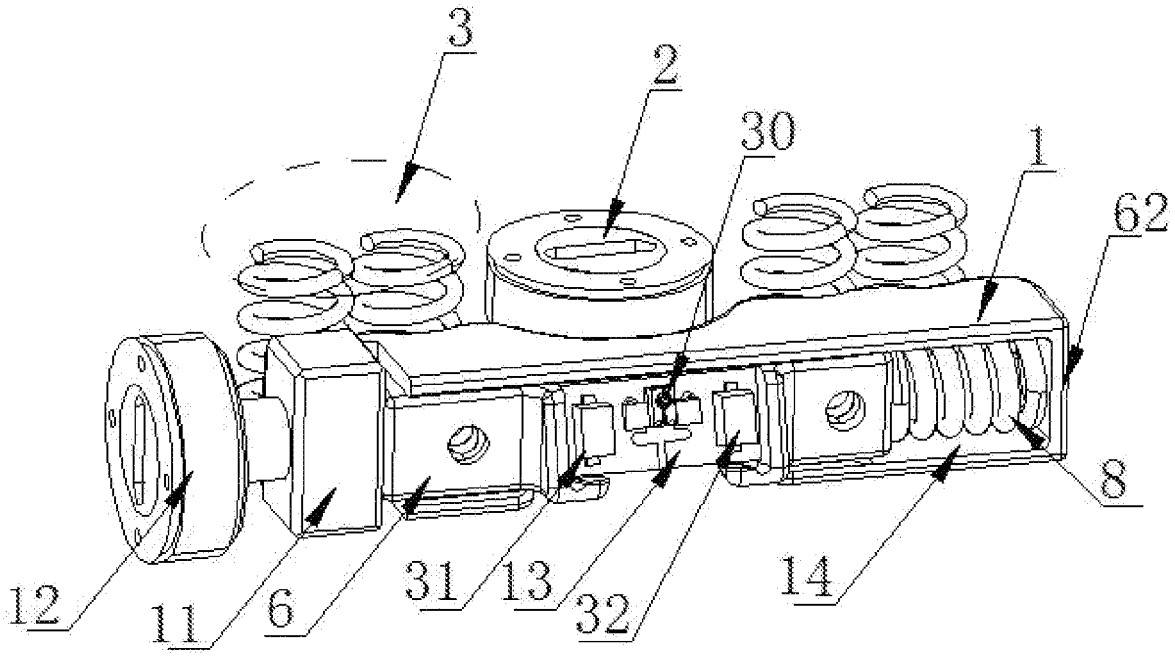
FIG. 1 is a schematic view of an LED emergent light adjusting mechanism.

In order to increase the stability of LED light source adjustment, improve shooting accuracy and provide compact structure, this embodiment provides an LED emergent light adjusting mechanism as shown in FIG. 1, including a vertical adjusting assembly and a horizontal adjusting assembly. The vertical adjusting assembly includes an up-and-down adjusting sliding block 1, a vertical adjustment screw 2, two vertical adjustment spring sets 3 (consisting of two coil springs in this embodiment) which are respectively arranged on two sides of the vertical adjustment screw 2 and are symmetrical with respect to the vertical adjustment screw 2. A nut member 4 is fixed at a middle portion of a bottom side at a rear end of the up-and-down adjusting sliding block 1 for threadedly connecting with a bolt of the vertical adjustment screw 2. Two guiding and limiting column sets 5 (generally each of which consists of two coil springs) are symmetrically provided on two sides of the nut member 4 for sleeving the vertical adjustment spring sets 3 thereon (the guiding and limiting column set is also composed of two monomers, mainly to prevent the reset coil spring from displacing), and a base of the guiding and limiting column set 5 is fixedly connected with the bottom side at the rear end of the up-and-down adjusting sliding block 1. This design structure mainly makes full use of the support of the rear end of the up-and-down adjusting sliding block 1 to the spring set to improve the working stability of the spring set, and at the same time makes full use of the space of the rear end of the up-and-down adjusting sliding block 1, so that the spring set has an appropriate length to meet the appropriate elastic requirements.

Figure 2:
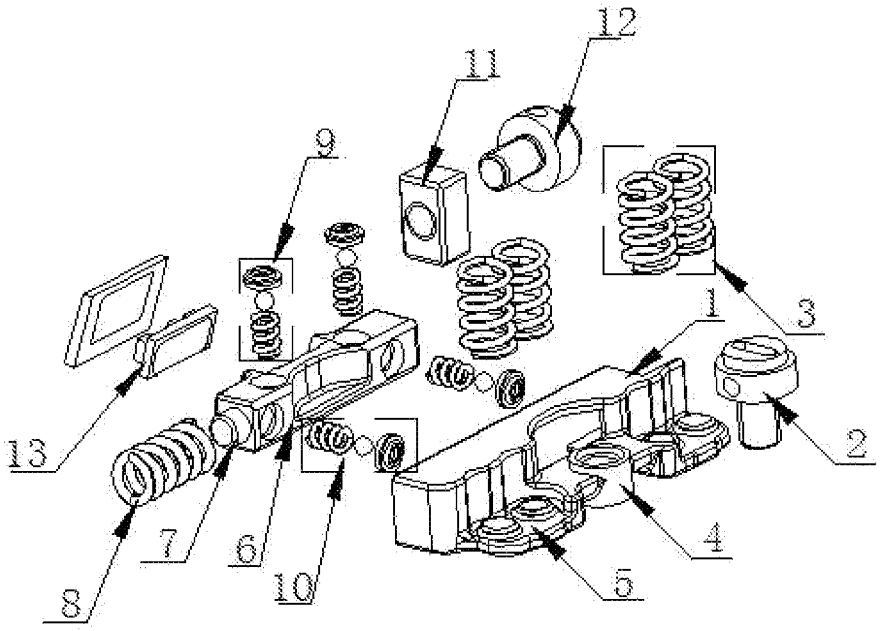
FIG. 2 is a disassembled schematic view of the LED emergent light adjusting mechanism.

As shown in FIG. 2, the horizontal adjusting assembly includes a left-and-right sliding block 6, a return spring 8 having one end sleeved on a limiting protrusion 7 at one end portion of the left-and-right sliding block 6, two vertical spring ejector pin assemblies 9 symmetrically arranged on a top surface of the left-and-right sliding block 6, two horizontal spring ejector pin assemblies 10 symmetrically arranged at a rear end of the left-and-right sliding block 6, a horizontal adjustment screw 12 coupled to the other end of the left-and-right sliding block 6 through a square nut 11, and a LED chip assembly 13 arranged on a front end surface of the left-and-right sliding block 6 (see FIG. 1). A mounting groove 14 is provided on a front end surface of the up-and-down adjusting sliding block 1, the left-and-right sliding block 6 is placed in the mounting groove 14, and the return spring 8 is placed between the left-and-right sliding block 6 and a baffle plate 62 fixed at one end portion of the mounting groove 14. The square nut 11 is placed outside the other end portion of the mounting groove 14. The vertical spring ejector pin assembly 9 is placed between the top surface of the left-and-right sliding block 6 and a top wall of the mounting groove 14, so as to eliminate a mounting gap in a vertical direction of the left-and-right sliding block 6. The horizontal spring ejector pin assembly 10 is placed between the rear end of the left-and-right sliding block 6 and a side wall of the mounting groove 14, so as to eliminate a mounting gap in a front-and-rear direction of the left-and-right sliding block 6.

Figure 6:
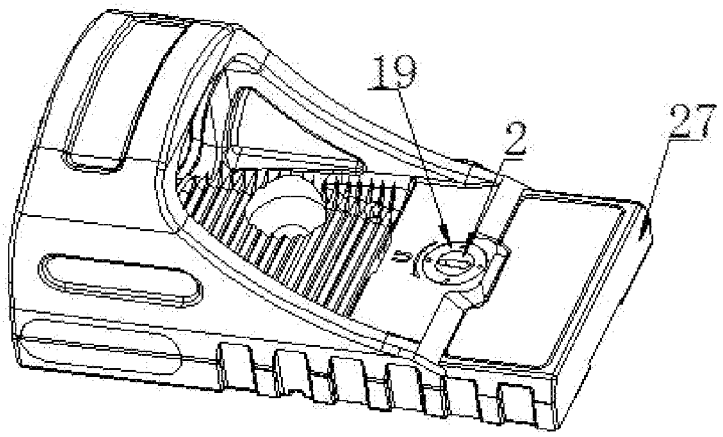
FIG. 6 is a perspective view of an inner-red-dot aiming device.
Figure 7:
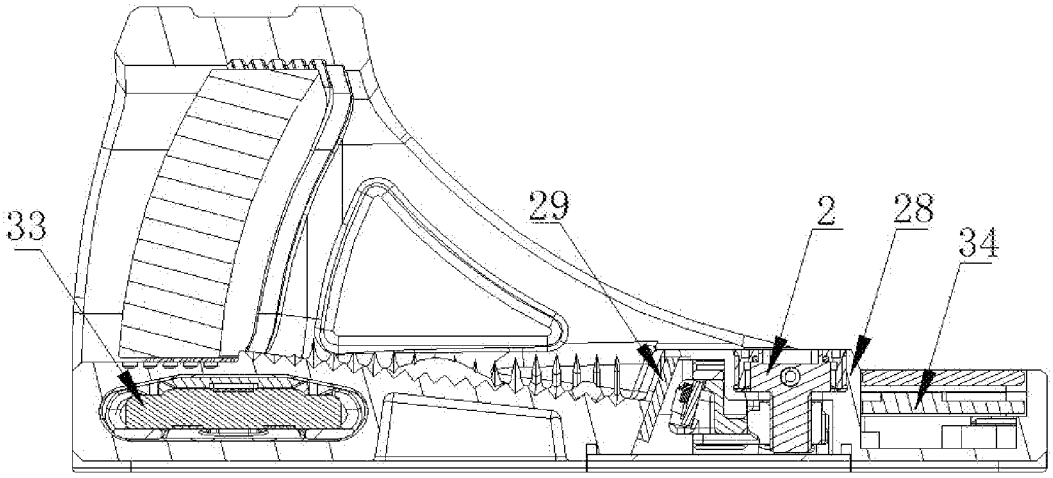
FIG. 7 is an axial sectional view of the inner-red-dot aiming device.

In this way, after the LED emergent light adjusting mechanism having the above structure is arranged in a mechanism mounting cavity 28 at a rear end of the aiming device base 27 of the inner-red-dot aiming device shown in FIGS. 6 and 7 (a front end of the mechanism mounting cavity 28 is provided with a window, and a rearwardly inclined protective glass 29 is mounted in the window), the LED chip assembly 13 is placed between the protective glass 29 and the left-and-right sliding block 6, and the horizontal adjusting screw 12 is mounted in a counterbore at a side of the rear end of the aiming device base 27 and is coupled to the square nut 11 mounted in the mechanism mounting cavity 28. By rotating the horizontal adjustment screw 12, the square nut 11 is driven to move back and forth along a screw shaft in an axial direction, thereby realizing the pushing of the left-and-right sliding block 6, and reversely pushing the left-and-right sliding block 6 under the elastic action of the return spring 8, so as to complete the adjustment of the left-and-right position of the left-and-right sliding block 6, and thus realize the adjustment of the left-and-right position of the LED light source 30 fixed on the front end of the left-and-right sliding block 6.

The vertical adjustment screw 2 is mounted in a counterbore at a top portion of the rear end of the aiming device base 27, and penetrates into the mechanism mounting cavity 28 to be threadedly coupled to the nut member 4. A top end of each of the two vertical adjustment spring set 3 abuts against inside of a top wall of the mechanism mounting cavity 28. In this way, the spring set 3 can be squeezed by rotating the vertical adjustment screw 2 clockwise, and at the same time push the up-and-down adjusting sliding block 1 fixedly coupled to the nut member 4 to move upward. The squeezing of the spring set 3 is cancelled when the vertical adjustment screw 2 is reversely rotated, and at the same time, the up-and-down adjusting sliding block 1 moves downward under the elastic action of the spring set 3. The left-and-right sliding block 6, on which a LED chip assembly is fixed at a front end thereof, is mounted in mounting groove 14 of the front end surface of the up-and-down adjusting sliding block 1, so that when the up-and-down adjustment of the vertical adjusting sliding block 1 is completed, the adjustment of the pitch angle of the LED chip assembly is completed simultaneously.

Figure 3:
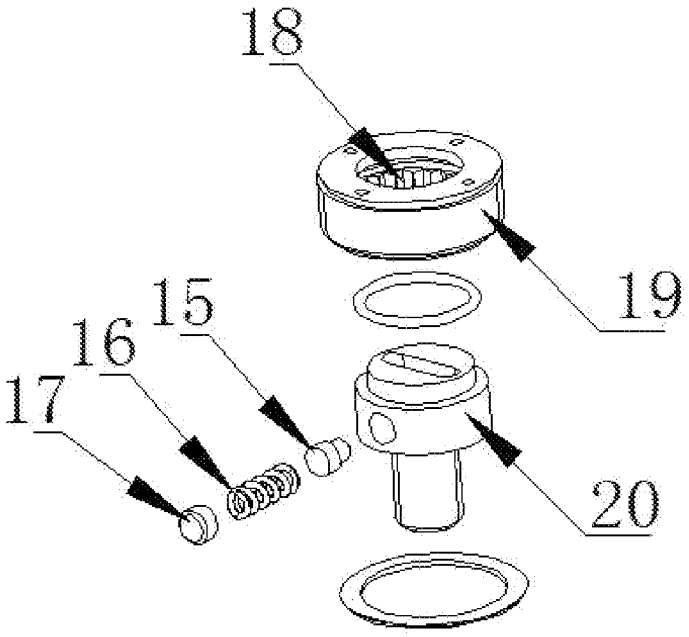
FIG. 3 is a disassembled schematic view of an assembly of a vertical adjusting screw or the horizontal adjusting screw.

In order to realize the fixation of the vertical adjustment screw 2 and the horizontal adjusting screw 12 and prevent them from falling off, each of the vertical adjustment screw 2 and the horizontal adjusting screw 12 provided by this embodiment includes a conical tip 15, a tip spring 16, a tip plug 17, and a fine-tuning gland 19 provided with a plurality of ribs 18 on an inner circumference surface, as shown in FIG. 3; wherein the conical tip 15, the tip spring 16 and the tip plug 17 are sequentially arranged on a radial mounting hole of a cap nut 20 of the horizontal adjusting screw 12 or the vertical adjustment screw 2, and an outer diameter of a large head end of the conical tip 15 is greater than an inner diameter of a top outlet of the mounting hole, so that a smaller head end of the conical tip 15 extends out to abut against the ribs 18, and when the vertical adjustment screw 2 and the horizontal adjusting screw 12 are rotated, the axial limit of the vertical adjustment screw 2 and the horizontal adjusting screw 12 can be realized, thereby ensuring the axial movement of the square nut 11 and the nut member 4. At the same time, a distance of axial displacement can be judged and adjusted by means of the sound of friction between the conical tip 15 and the ribs 18. Specifically, an angle between the ribs 18 is 15°, and 24 ribs are evenly arranged along an inner side of the fine-tuning gland 19 in a circumferential direction, so that the LED chip assembly 13 moves between upward and downward or between leftward and rightward by a certain distance once the vertical adjustment screw 2 or the horizontal adjusting screw 12 rotates and slides over one of the ribs 18, and then the adjustment angle value of the LED chip assembly can be obtained by the relationship between the axial moving distance and the adjustment angle, and the vertical adjustment screw 2 or the horizontal adjusting screw 12 can be effectively prevented from being loosened due to vibration by means of the friction force between the conical tip 15 and the ribs 18.

Figure 4:
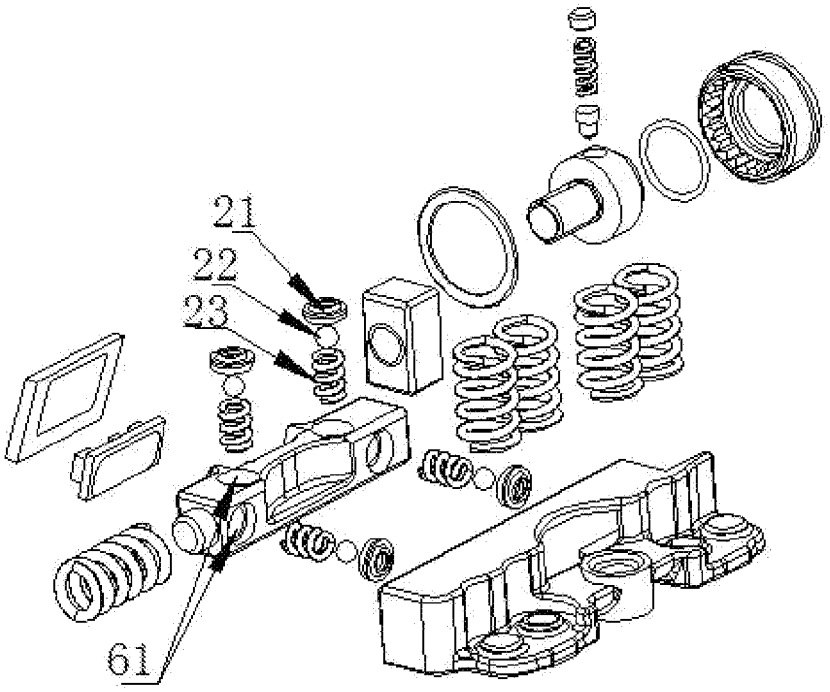
FIG. 4 is a structural disassembled view of a vertical spring ejector pin assembly or a horizontal spring ejector pin assembly.
Figure 5:
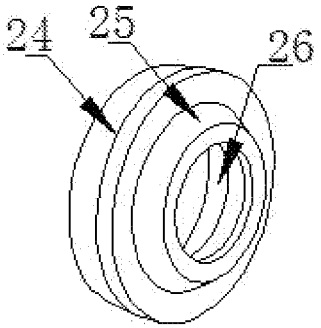
FIG. 5 is a structural schematic view of a steel ball gland.

In order to ensure the stability of the adjustment process and to facilitate the control of adjustment accuracy, the vertical spring ejector pin assembly 9 or the horizontal spring ejector pin assembly 10 provided by this embodiment is composed of a steel ball gland 21, a steel ball 22 and a steel ball pressure spring 23 as shown in FIG. 4, wherein the steel ball 22 is pressed on a through hole of the steel ball gland 21 by the steel ball pressure spring 23, and a pore diameter of the through hole is smaller than an outer diameter of the steel ball 22, and the steel ball gland 21 is formed by integrally connecting a ring portion and a trumpet portion 25 as shown in FIG. 5 to form a conical hole 26 penetrating through the steel ball gland 21; the steel ball 22 touches and is pressed on the ring portion 24. During mounting, the steel ball pressure spring 23 and the steel ball 22 are sequentially mounted in a blind hole 61 on the top surface or a rear end surface of the left-and-right sliding block 6 from inside to outside, and the steel ball gland 21 is pressed between the steel ball 22 and an inner surface of a top plate of the mechanism mounting cavity 28 (at this time, it is mounted in the blind hole on the top surface of the left-and-right sliding block 6), or is pressed between the steel ball 22 and the front end surface of the up-and-down adjustment sliding block 1 (at this time, it is mounted in the blind hole 61 of the rear end surface of the left-and-right sliding block 6). The stability of the adjustment of the left-and-right sliding block 6 or the up-and-down adjusting sliding block 1 can be greatly improved by the arrangement of the vertical spring ejector pin assembly 9 or the horizontal spring ejector pin assembly 10.

The LED chip assembly 13 provided by this embodiment includes an LED light source composed of a central point light source and a discontinuous annular light source surrounding around the central point light source, and the LED chip assembly 13 includes a control circuit board, a left PD (photodiode) 31 and a right PD 32 symmetrically arranged on both sides of the LED light source 30 as shown in FIG. 1; wherein the control circuit board is respectively electrically connected with a battery 33 arranged at the front end of the aiming device base 27 as shown in FIG. 7 and a solar cell 34 arranged at the rear end of the mechanism mounting cavity 28; the left PD 31 and the right PD 32 are configured to collect the ambient light emitted into the protective glass 29, so that when a light intensity of the ambient light is greater than or equal to a given threshold, the central point light source and the discontinuous annular light source are powered simultaneously by the control circuit board, and when the light intensity of the ambient light is less than the given threshold, only the central point light source is powered by the control circuit board, and when the ambient light is not enough to drive the central point light source, the power is supplied by the battery 33.

Figure 8:
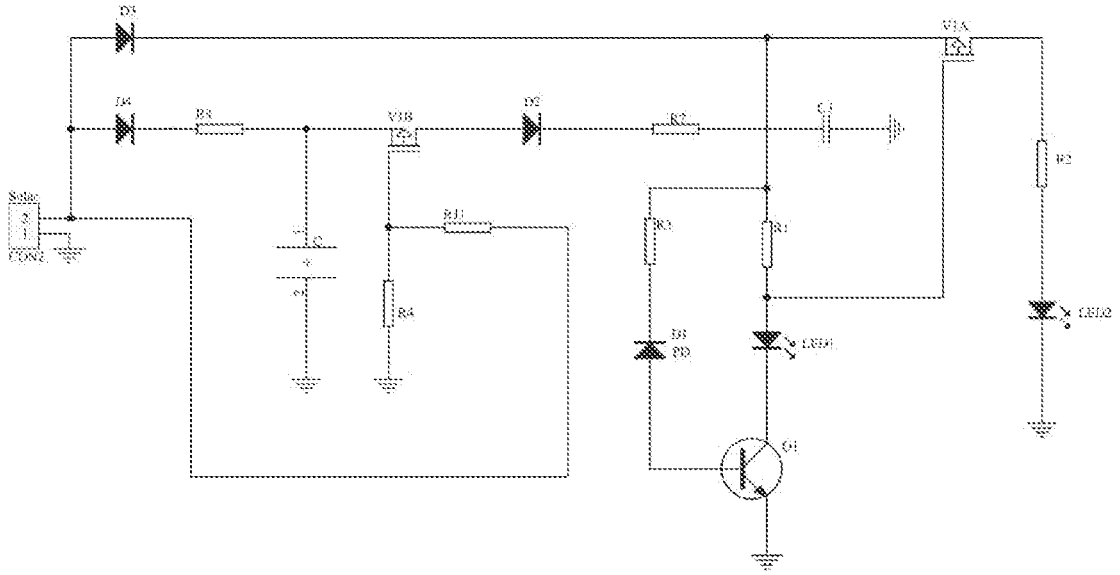
FIG. 8 is an electronic circuit diagram of LED1 and LED2 with non-common polarity.
Figure 9:
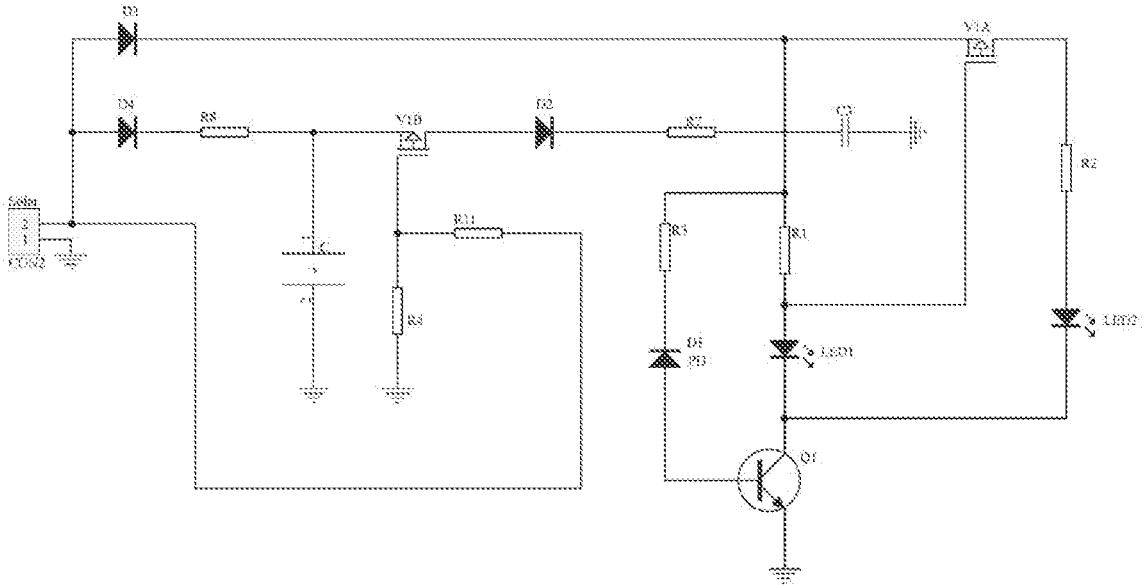
FIG. 9 is an electronic circuit diagram of LED1 and LED2 with a common cathode.
Figure 10:
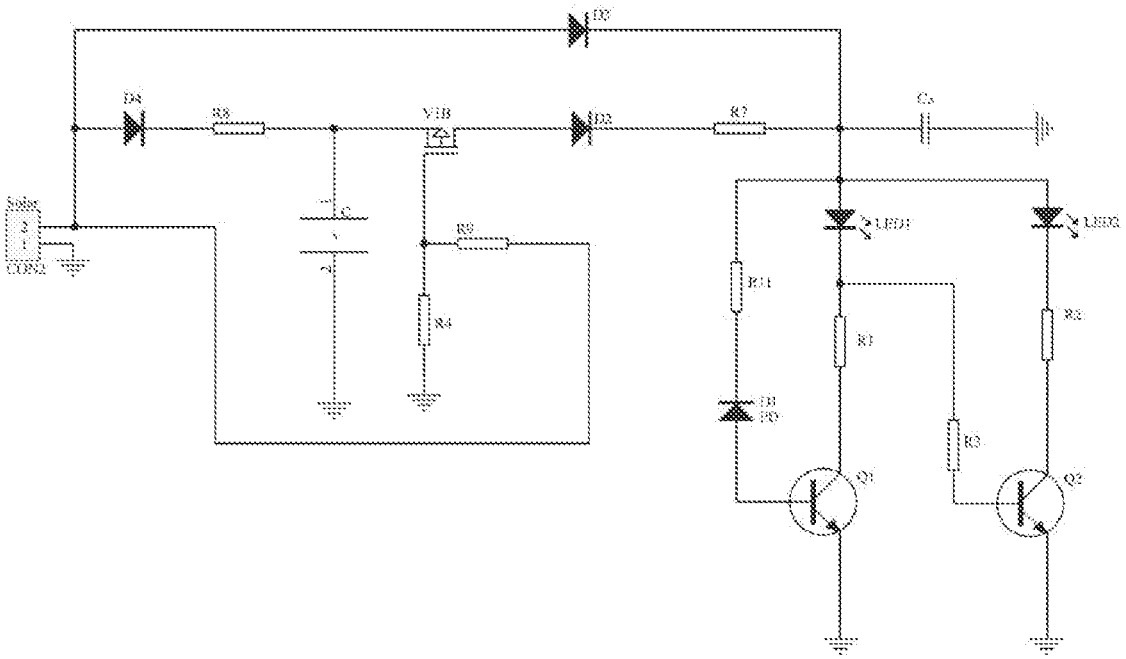
FIG. 10 is an electronic circuit diagram of LED1 and LED2 with a common anode.

The specific electronic circuit design can refer to FIGS. 8, 9 and 10. FIG. 8 is an electronic circuit diagram of LEDs with non-common polarity. Specifically, when the ambient light is weak or there is no solar energy, V1B (P-MOS tube) may be controlled through voltages divided by electronics R11 and R4 to turn on or partially turn on, a backup battery (or a supercapacitor) C supplies power to LED1 through a reverse cut-off diode D2, current limit resistors R7 and R1, and PD samples the brightness of ambient light to control the turn-on degree of audion Q1 and adjusts the current to LED1. At this time, due to the current limit resistors R7 and PD, the current flowing through R1 is relatively small, the voltage difference across R1 cannot control V1A (P-MOS tube) to turn on or partially turn on, and LED2 cannot work; when the ambient light is strong, the solar energy Solar supplies power to the backup battery (or supercapacitor) C through D4, the solar energy controls V1B (P-MOS tube) to turn off through the voltages divided by electronics R11 and R4, the current flowing through R1 is relatively large, the voltage difference across R1 can control V1A (P-MOS tube) to turn on or partially turn on, and LED2 can start to work. When the voltage difference of R1 enables VIA to fully turn on, LED2 works without being affected by PD, a higher power LED can be driven.

FIG. 9 is an electronic circuit diagram of LEDs with a common cathode, specifically, when the ambient light is weak or there is no solar energy, the V1B (P-MOS tube) may be controlled through voltages divided by electronics R11 and R4 to turn on or partially turn on, a backup battery (or a supercapacitor) C supplies power to LED1 through a reverse cut-off diode D2, current limit resistors R7 and R1, and PD samples the brightness of ambient light to control the turn-on degree of audion Q1 and adjusts the current to LED1. At this time, due to the current limit resistors R7 and PD, the current flowing through R1 is relatively small, the voltage difference across R1 cannot control V1A (P-MOS tube) to turn on or partially turn on, and LED2 cannot work; when the ambient light is strong, the solar energy Solar supplies power to the backup battery (or supercapacitor) C through D4, the solar energy controls V1B (P-MOS tube) to turn off through the voltages divided by electronics R11 and R4, the current flowing through R1 is relatively large, the voltage difference across R1 can control V1A (P-MOS tube) to turn on or partially turn on, LED2 can start to work, and LED2 is still under the control of PD.

FIG. 10 is an electronic circuit diagram of LEDs with a common anode, specifically, when the ambient light is weak or there is no solar energy, the V1B (P-MOS tube) may be controlled through voltages divided by electronics R11 and R4 to turn on or partially turn on, a backup battery (or a supercapacitor) C supplies power to LED1 through a reverse cut-off diode D2, current limit resistors R7 and R1, and PD samples the brightness of ambient light to control the turn-on degree of audion Q1 and adjusts the current to LED1. At this time, due to the current limit resistors R7 and PD, the current flowing through R1 is relatively small, the voltage difference across R1 cannot control Q2 to turn on or partially turn on, and LED2 cannot work; when the ambient light is strong, the solar energy Solar supplies power to the backup battery (or supercapacitor) C through D4, the solar energy controls V1B (P-MOS tube) to turn off through the voltages divided by electronics R11 and R4, the current flowing through R1 is relatively large, the voltage difference across R1 can control Q2 to turn on or partially turn on, and LED2 can start to work. FIGS. 8, 9 and 10 are schematic views of driving 2 LEDs. Similarly, 3, 4 or more LEDs may be driven.

Through this control method, it can be well controlled to only supply power to the central point light source or to supply power to the surrounding light sources at the same time according to the intensity of the ambient light, so as to ensure that when the ambient light is strong, it can provide a bright enough shooting target, and when the ambient light is weak, only the central point light source is powered to meet the brightness requirements of the shooting target while charging the rechargeable battery, making reasonable use of ambient light and using the electric energy of the rechargeable battery, reducing the waste of the electric energy and prolonging the service life of the rechargeable battery. Compared with the existing simultaneous use of MCU (micro control unit or single chip microcomputer) to control the brightness of the LED and the switching of the power supply by collecting the signal of the PD and the solar cell, the present disclosure has the advantages of low cost and low power consumption.

Figure 11:
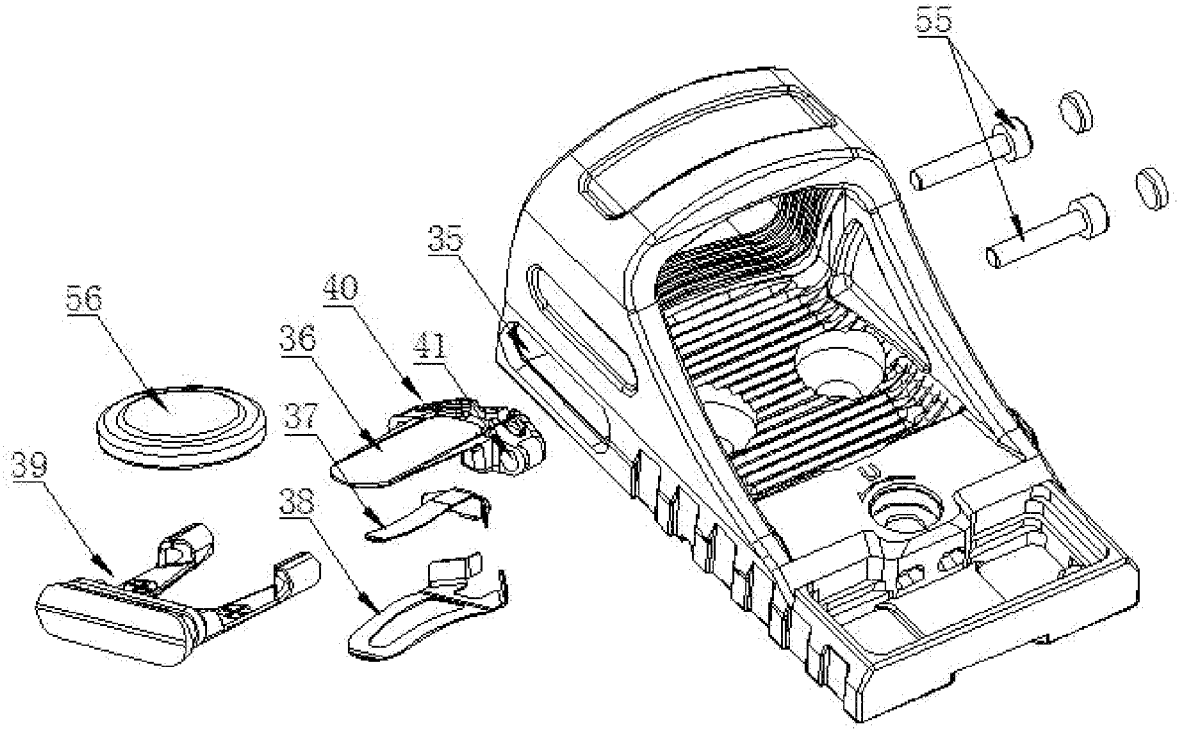
FIG. 11 is a disassembled schematic view of a battery holder assembly and an aiming device base.
Figure 12:
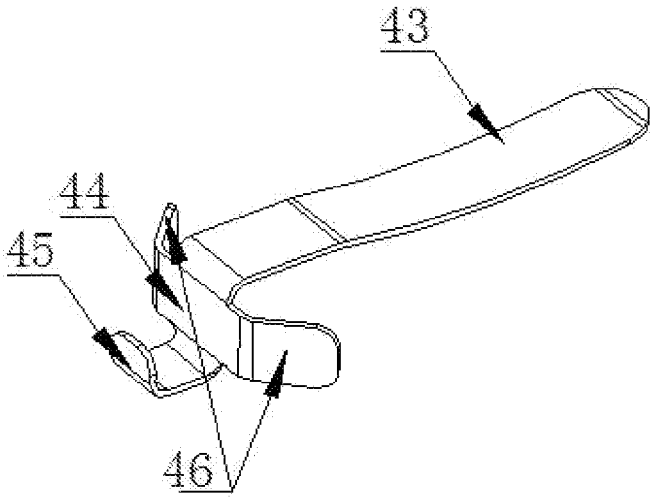
FIG. 12 is a structural schematic view of a negative electrode elastic sheet.
Figure 13:
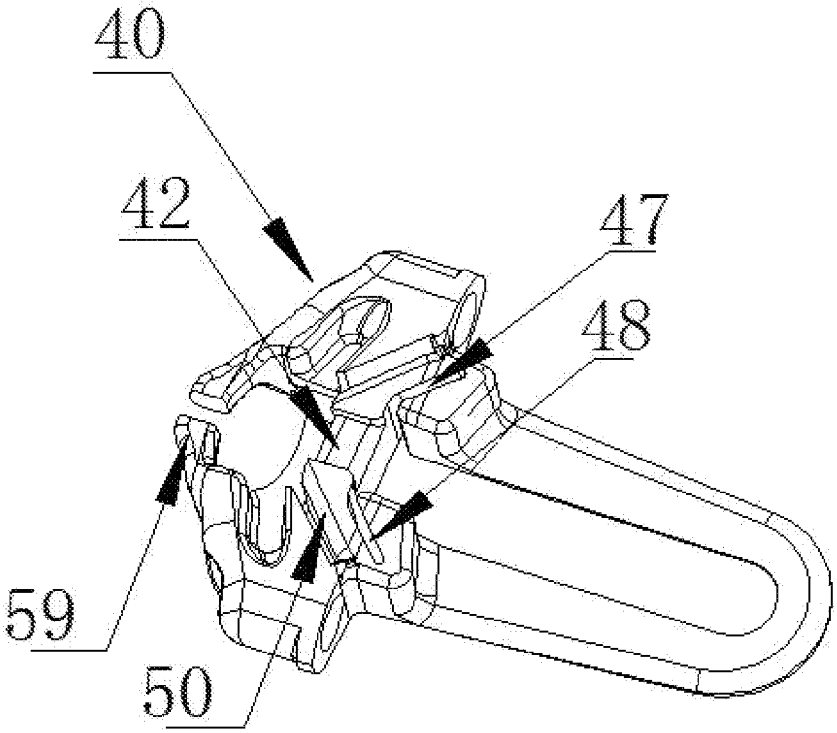
FIG. 13 is a structural schematic view of a horizontal pressure sheet, in which a fixing seat is integrally arranged at a rear end of the horizontal pressure sheet.
Figure 14:
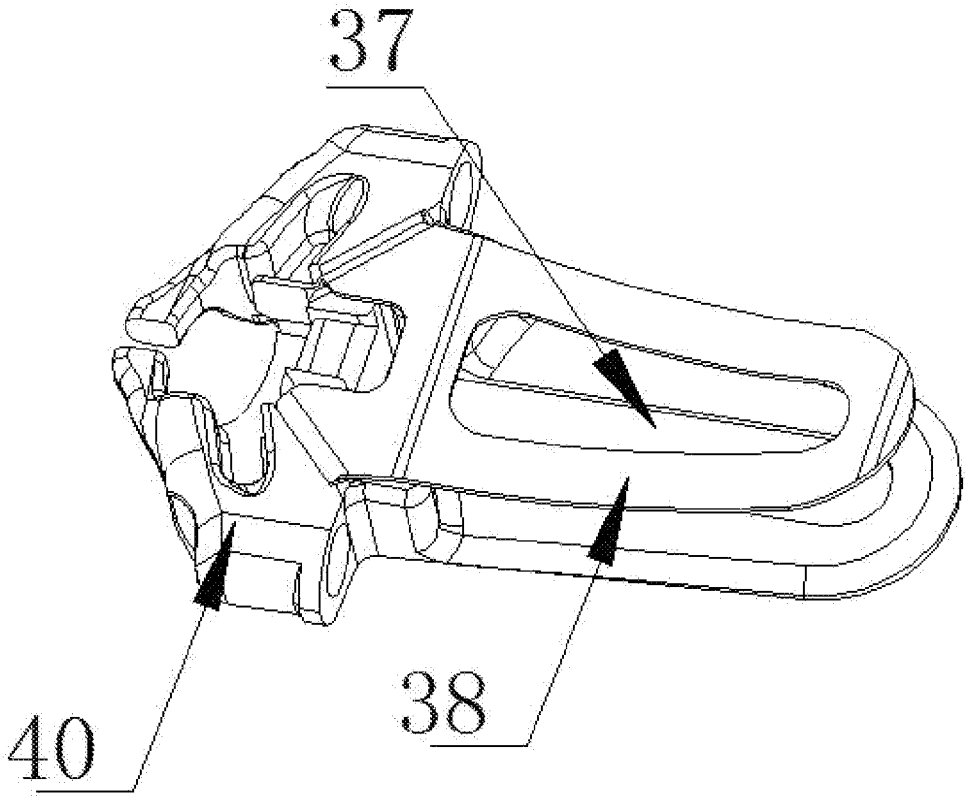
FIG. 14 is a view of the structure as shown in FIG. 13 in which the negative electrode elastic sheet and a positive electrode elastic sheet are installed.

As shown in FIG. 11, a battery compartment 35 and a battery holder assembly placed in the battery compartment 35 are provided at the front end of the aiming device base 27. The battery holder assembly includes a horizontal pressure sheet 36, a negative electrode elastic sheet 37, a positive electrode elastic sheet 38 and a battery holder 39 (for supporting the rechargeable lithium battery 56); wherein an inner end of the horizontal pressure sheet 36 is centrally connected with a top portion of an outer surface of a fixing seat 40; each of left and right ends of the fixing seat 40 is provided with a fixing seat screw hole 41; the outer surface of the fixing seat 40 is provided with a protrusion below the inner end of the horizontal pressure sheet 36, so as to abut against a clamping elastic sheet 45 in a structure of the negative electrode elastic sheet 37 as shown in FIG. 12, enable the negative electrode elastic sheet 37 to be stabilized on the horizontal pressure sheet 36 under an elastic clamping action, and a bottom surface of the fixing seat 40 is provided with a negative electrode elastic sheet mounting groove; as shown in FIG. 13, the negative electrode elastic sheet mounting groove includes a limiting beam 42 at the rear and fin limiting grooves 47, 48 extending outward from both sides of a front end of the limiting beam 42. It can be seen from FIG. 14, a vertical segment 44 and a clamping elastic sheet 45 are clamped on the limiting beam 42, wherein the vertical segment 44 abuts against a front side wall of the limiting beam 42, and the clamping elastic sheet 45 abuts against a rear side wall of the limiting beam 42. As shown in FIG. 12, the negative electrode elastic sheet 37 includes an elastic sheet body 43; a clamping elastic sheet 45 connected with an inner end of the elastic sheet body 43 through the vertical segment 44, and horizontally extending rearward and bending upward; and a limiting sheet 46 connected with each of left and right sides of the vertical segment 44. The limiting sheet 46 is inclined from a connection with the vertical segment 44 to a side away from the elastic sheet body 43 in a direction of an outer end of the elastic sheet body 43. With the limiting beam 42 on the fixing seat 40, the fin limiting grooves 47 and 48 fix the negative electrode elastic sheet 37 on the horizontal pressing sheet 36, and the elastic sheet body 43 is placed on the bottom surface of the horizontal pressing sheet 36.

Figure 15:
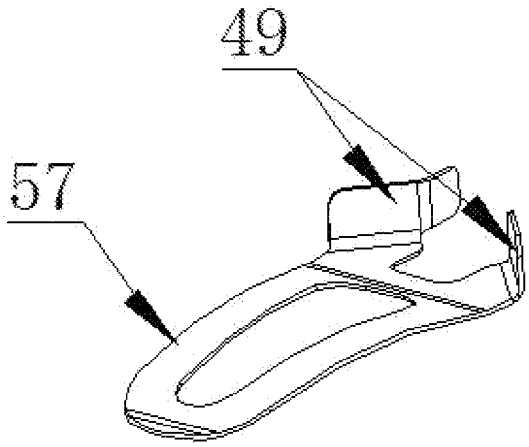
FIG. 15 is a structural schematic view of the positive electrode elastic sheet.
Figure 16:
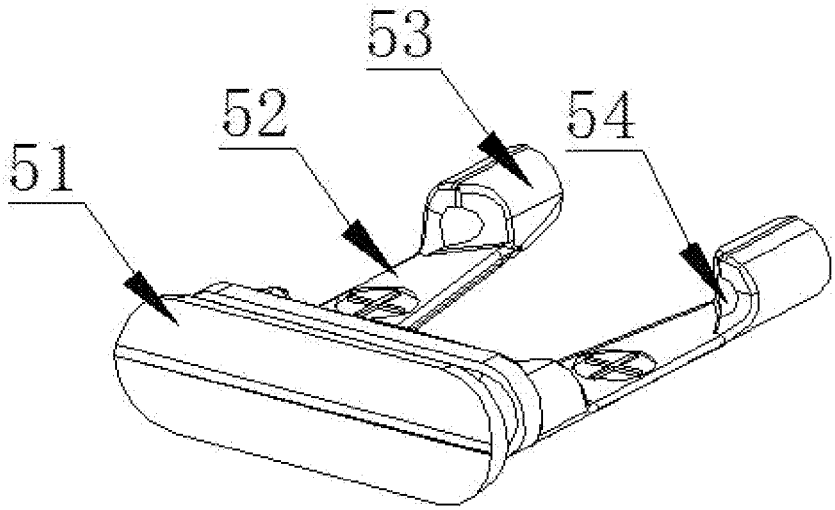
FIG. 16 is a structural schematic view of the battery holder.

Similarly, the bottom surface of the fixing seat 40 is provided with a limiting groove 50 for assembling the limiting fin 49 at a tail end of the positive electrode elastic sheet 38 as shown in FIG. 15 to fix the positive electrode elastic sheet 38. A space for placing a rechargeable lithium battery 56 is provided between the positive electrode elastic sheet 38 and the elastic sheet body 43, and a sheet body of the positive electrode elastic sheet 38 is placed in a space between two supporting members of the battery holder 39 symmetrically arranged at inner ends of the block portion 51 as shown in FIG. 16.

In order to fix the battery compartment assembly and securely mount the rechargeable lithium battery 56, a supporting member screw hole portion 53 coaxial with the fixing seat screw hole 41 is provided on a top surface of a tail end of the supporting member 52. The fixing screw 55 as shown in FIG. 10 penetrates into the battery compartment 35 from the other side of the aiming device base 27, and is sequentially connected with the fixing seat screw hole 41 and a screw hole 54 on the supporting member screw hole portion 53. The rechargeable lithium battery 56 does not need to be replaced frequently in actual use, and thus this fixing structure can well achieve the stable and reliable fixing of the rechargeable lithium battery 56.

Figure 17:
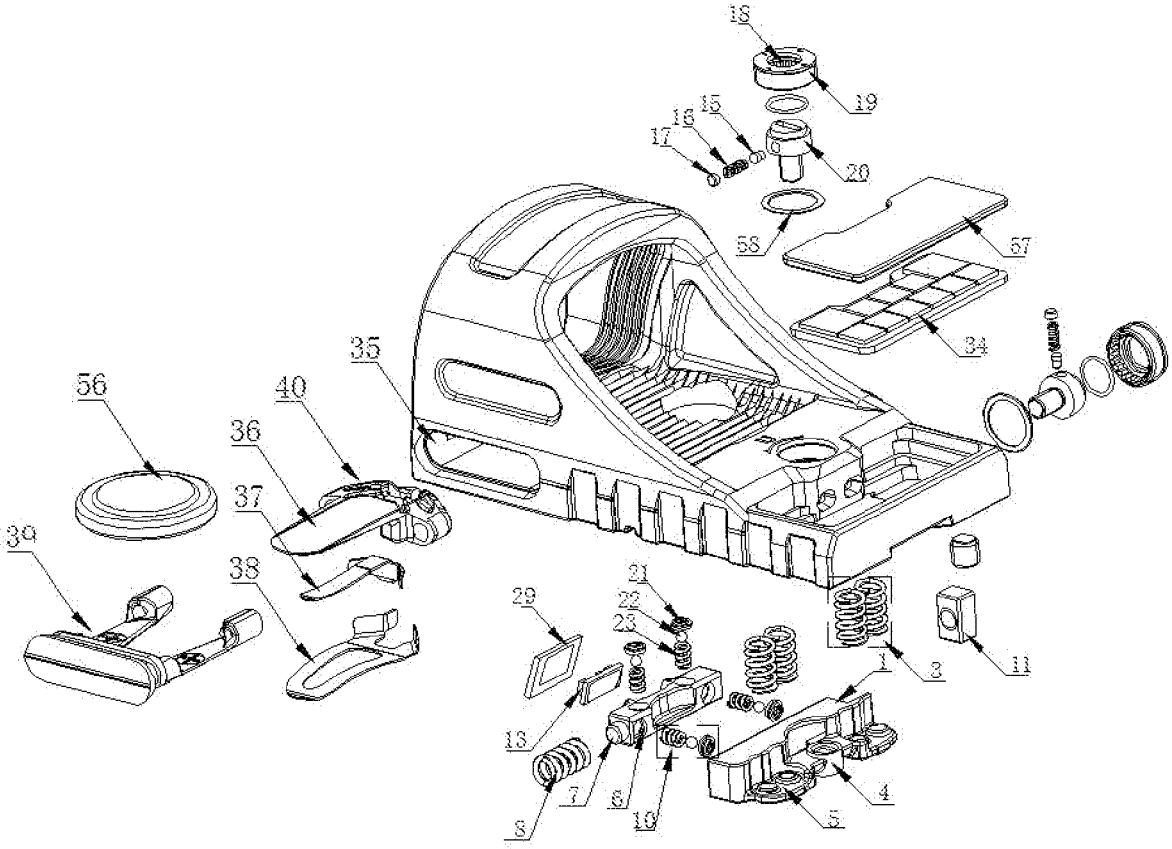
FIG. 17 is a structural exploded view of an aiming device.

Finally, it can be seen from FIG. 17 that a solar protective glass 57 is provided outside the solar cell 34, the chip protective glass 29 and the O-ring 58 provided outside the LED chip assembly 13 are common components, which will not be described herein.

Figure 18:
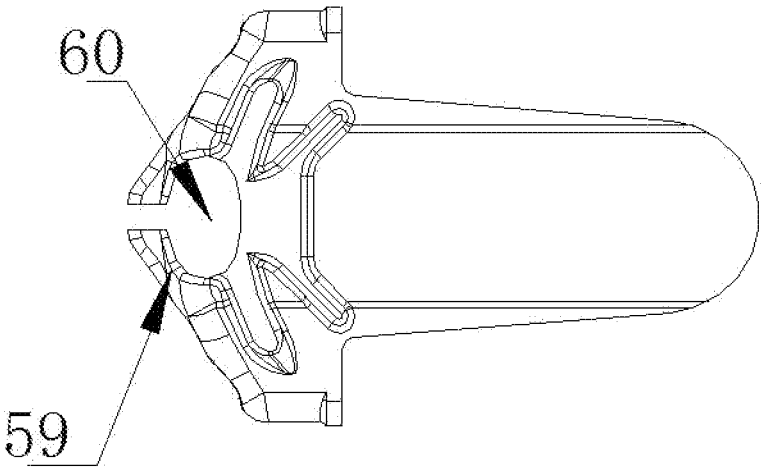
FIG. 18 is a top view when the horizontal pressure sheet is integrated with the fixing seat.

In order to improve the stability and fastening force for mounting the battery compartment, and ensure that the fixing screw 55 is always in a stressed state, as shown in FIG. 18, two elastic abutting portions 59 symmetrically distributed and placed between the fixing seat screw holes 41 are provided at an inner end of the fixing seat 40 (that is, an end towards the battery compartment during mounting is an inner end). The two elastic abutting portions 59 extend opposite to each other to form an encircling state, and form an elliptical space 60 with an assembling groove (such as the fin limiting groove 47), so as to provide a retraction space sufficient for the elastic abutting portion 59 when being abutted and.

What is claimed is:

1. An LED emergent light adjusting mechanism, comprising a vertical adjusting assembly and a horizontal adjusting assembly, wherein the vertical adjusting assembly comprises an up-and-down adjusting sliding block, a vertical adjustment screw, and two vertical adjustment spring sets which are respectively arranged on two sides of the vertical adjustment screw and are symmetrical with respect to the vertical adjustment screw;

a nut member fixed at a middle portion of a bottom side at a rear end of the up-and-down adjusting sliding block for threadedly connecting with a bolt of the vertical adjustment screw;

two guiding and limiting column sets symmetrically provided on two sides of the nut member for sleeving the vertical adjustment spring sets thereon, a base of each guiding and limiting column set being fixedly connected with the bottom side at the rear end of the up-and-down adjusting sliding block;

the horizontal adjusting assembly comprises a left-and-right sliding block, a return spring having one end sleeved on a limiting protrusion at one end portion of the left-and-right sliding block, two vertical spring ejector pin assemblies symmetrically arranged on a top surface of the left-and-right sliding block, two horizontal spring ejector pin assemblies symmetrically arranged at a rear end of the left-and-right sliding block, a horizontal adjustment screw coupled to another end of the left-and-right sliding block through a square nut, and an LED chip assembly arranged on a front end surface of the left-and-right sliding block;

a mounting groove is provided on a front end surface of the up-and-down adjusting sliding block, the left-and-right sliding block is placed in the mounting groove, and the return spring is placed between the left-and-right sliding block and a baffle plate fixed at an end portion of the mounting groove; the square nut is placed outside another end portion of the mounting groove;

each vertical spring ejector pin assembly is placed between the top surface of the left-and-right sliding block and a top wall of the mounting groove to eliminate a mounting gap in a vertical direction of the left-and-right sliding block;

each horizontal spring ejector pin assembly is placed between the rear end of the left-and-right sliding block and a side wall of the mounting groove to eliminate a mounting gap in a front-and-rear direction of the left-and-right sliding block;

the LED chip assembly comprises an LED light source composed of a central point light source and a discontinuous annular light source surrounding around the central point light source.

2. The LED emergent light adjusting mechanism according to claim 1, wherein each of the vertical adjustment screw and the horizontal adjustment screw comprises a conical tip, a tip spring, a tip plug, and a fine-tuning gland provided with a plurality of ribs at an inner circumference surface;

the conical tip, the tip spring and the tip plug are sequentially arranged in a radial a mounting hole of a cap nut of the horizontal adjustment screw or the vertical adjustment screw, and an outer diameter of a large head end of the conical tip is greater than an inner diameter of a top outlet of the mounting hole, so that a small head end of the conical tip extends out to abut against the ribs to prevent the vertical adjustment screw or the horizontal adjustment screw from being loosened due to vibration.

3. The LED emergent light adjusting mechanism according to claim 2, wherein an angle between the ribs is 15°, and 24 ribs are evenly arranged along an inner side of the fine-tuning gland in a circumferential direction, so that the LED chip assembly moves between upward and downward or between leftward and rightward by a certain distance once the vertical adjustment screw or the horizontal adjusting screw rotates and slides over one of the ribs.

4. The LED emergent light adjusting mechanism according to claim 1, wherein the vertical spring ejector pin assembly or the horizontal spring ejector pin assembly is composed of a steel ball gland, a steel ball and a steel ball pressure spring, the steel ball is pressed on a through hole of the steel ball gland by the steel ball pressure spring, and a pore diameter of the through hole is smaller than an outer diameter of the steel ball.

5. The LED emergent light adjusting mechanism according to claim 4, wherein the steel ball gland is formed by integrally connecting a ring portion and a trumpet portion to form a conical hole penetrating through the steel ball gland;

the steel ball touches and is pressed on the ring portion.

6. An inner-red-dot aiming device having the LED emergent light adjusting mechanism according to claim 1, comprising an aiming device base, wherein the LED emergent light adjusting mechanism is arranged in a mechanism mounting cavity at a rear end of the aiming device base; and a front end of the mechanism mounting cavity is provided with a window, and a rearwardly inclined protective glass is mounted in the window;

the LED chip assembly is placed between the protective glass and the left-and-right sliding block, and comprises an LED light source composed of a central point light source and a discontinuous annular light source surrounding around the central point light source;

the horizontal adjustment screw is mounted in a counterbore at a side of the rear end of the aiming device base and is coupled to the square nut, which is mounted in the mechanism mounting cavity;

the vertical adjustment screw is mounted in a counterbore at a top portion of the rear end of the aiming device base, and penetrates into the mechanism mounting cavity to be threadedly coupled to the nut member;

a top end of each of the two vertical adjustment spring sets abuts against inside of a top wall of the mechanism installation cavity.

7. The inner-red-dot aiming device according to claim 6, wherein the LED chip assembly comprises a circuit board, a left PD and a right PD symmetrically arranged on both sides of the LED light source; the circuit board is electrically connected with a battery arranged at the front end of the aiming device base and a solar battery arranged at the rear end of the mechanism mounting cavity, respectively;

the left PD and the right PD are configured to collect an ambient light emitted into the protective glass, so that when a light intensity of the ambient light is greater than or equal to a given threshold, the central point light source and the discontinuous annular light source are powered simultaneously by the circuit board, while the battery is charged; and when the light intensity of the ambient light is less than the given threshold, only the central point light source is powered by the circuit board; and when the ambient light is not enough to drive the central point light source, the power is supplied by the battery.

8. The inner-red-dot aiming device according to claim 6, wherein a battery compartment and a battery holder assembly placed in the battery compartment are provided at the front end of the aiming device base, the battery holder assembly comprises a horizontal pressure sheet, a negative electrode elastic sheet, a positive electrode elastic sheet and a battery holder;

an inner end of the horizontal pressure sheet is centrally connected with a top portion of an outer surface of a fixing seat; each of left and right ends of the fixing seat is provided with a fixing seat screw hole;

a bottom surface of the fixing seat is provided with a negative electrode elastic sheet mounting groove;

the negative electrode elastic sheet comprises an elastic sheet body placed on a bottom surface of the horizontal pressure sheet, a clamping elastic sheet connected with an inner end of the elastic sheet body through a vertical segment and horizontally extending rearward and bending upward; and a limiting sheet connected with each of left and right sides of the vertical segment; wherein the limiting sheet is inclined from a connection with the vertical segment to a side away from the elastic sheet body in a direction of an outer end of the elastic sheet body;

the negative electrode elastic sheet mounting groove comprises a limiting beam at its rear and fin limiting grooves (47, 48) extending outward from both sides of a front end of the limiting beam; the vertical segment and the clamping elastic sheet are clamped on the limiting beam, wherein the vertical segment abuts against a front side wall of the limiting beam, and the clamping elastic sheet abuts against a rear side wall of the limiting beam, so that the elastic sheet body is fastened to a bottom surface of the horizontal pressure sheet;

a limiting groove for assembling the limiting fin at a tail end of the positive electrode elastic sheet is provided on the bottom surface of the fixing seat;

the battery holder is composed of a block portion that are convenient to plug in and out and two supporting members symmetrically arranged at inner ends of the block portion;

a supporting member screw hole portion coaxial with the fixing seat screw hole is provided on a top surface of a tail end of the supporting member;

the fixing screw penetrates into the battery compartment from another side of the aiming device base, and is sequentially connected with the fixing seat screw hole and a screw hole on the supporting member screw hole portion.

9. The inner-red-dot aiming device according to claim 8, wherein two elastic abutting portions symmetrically distributed and placed between the fixing seat screw holes are provided at an inner end of the fixing seat;

the two elastic abutting portions extend opposite to each other to form an encircling state, and form an elliptical space with an assembling groove, so as to provide a retraction space sufficient for the elastic abutting portion when being abutted.

* * * * *